United States Patent [19]

Toronyi et al.

[11] 3,991,548

[45] Nov. 16, 1976

[54] COMPOSITE YARNS

[75] Inventors: Zoltan Steve Toronyi; Ralph Carl Wirsig, both of Kingston, Canada

[73] Assignee: Du Pont of Canada, Ltd., Montreal, Canada

[22] Filed: Mar. 14, 1974

[21] Appl. No.: 451,117

[30] Foreign Application Priority Data

Mar. 16, 1973 United Kingdom ..... 12856/73

[52] U.S. Cl. ..... 57/140 BY; 57/34 HS; 57/152; 57/157 TS; 57/160; 57/163

[51] Int. Cl.[2] ..... D02G 1/02; D02G 3/32

[58] Field of Search ..... 57/12, 34 HS, 157 TS, 57/140 BY, 144, 152, 160, 163

[56] References Cited

UNITED STATES PATENTS

| | | | |
|---|---|---|---|
| 3,501,819 | 3/1970 | Satterwhite | 28/1.3 |
| 3,540,204 | 11/1970 | Tanaka et al. | 57/163 |
| 3,577,873 | 5/1971 | Waters | 57/144 |
| 3,691,750 | 9/1972 | Waters | 57/144 |
| 3,763,640 | 10/1973 | Nagel et al. | 57/34 HS |
| 3,807,162 | 4/1974 | Tsujita et al. | 57/152 |
| 3,844,103 | 10/1974 | Sasaki et al. | 57/157 TS |

*Primary Examiner*—John Petrakes

[57] ABSTRACT

A composite yarn consisting of an elastomeric yarn intermingled with a non-elastomeric multifilament yarn and a process for its manufacture comprising the steps of: feeding an elastomeric yarn and a non-elastomeric multifilament yarn through a draw zone adapted to temporarily stretch the elastomeric yarn and to draw the non-elastomeric multifilament yarn and false twisting the elastomeric yarn and the non-elastomeric multifilament yarn together to form a false twisted doubled yarn to a heat setting treatment at a temperature below that at which the elastomeric yarn elasticity would be substantially destroyed.

10 Claims, 8 Drawing Figures

COMPOSITE YARNS

The present invention relates to the production of composite yarns and more particularly to composite yarns possessing elastic properties and comprising intermingled elastomeric and non-elastomeric continuous filament components. Such yarns are readily converted into fabrics and garments having improved elasticity, compared to previously available false twist textured yarn and particularly into fabric structures having stretch or "comfort" properties.

The term "elastomeric yarn", as used herein, refers to a yarn having a high degree of reversible extensibility, e.g. greater than 100% of original length, and typically a yarn composed of filament (s) of a segmented polyurethane, generically termed a spandex fibre. The term "non-elastomeric yarn" as used herein refers to a yarn having a relatively low degree of extensibility, e.g. less than 50% of original length at break and, typically, a yarn composed of filaments of a thermoplastic polymeric material, e.g. a polyamide or a polyester, such as are used in the manufacture of plain or textured yarns.

Composite yarns possessing elastic properties and consisting of elastomeric yarn associated with non-elastomeric multifilament yarn are well known in the art.

Burleson et al, in U.S. Pat. No. 3,069,883, issued Dec. 25, 1962, disclose wrapping a synthetic elastomeric yarn, namely polyurethane yarn, while stretched to between 40 and 90% of its maximum stretch in the unwrapped condition with at least one layer of a non-elastomeric wrapping yarn, such wrapping yarn being preferably a multifilament nylon yarn, either plain or textured. Such single or multi-covered yarns are used in the manufacture of compressive fabrics, e.g. surgical or support garments in which supportive power is of prime importance.

R. M. Lodge, in Canadian Pat. No. 719,047, issued Oct. 5, 1965, discloses a composite yarn comprising elastomeric synthetic filaments associated with crimped or textured non-elastomeric synthetic filaments. Lodge teaches that in making the composite yarn, it is important to control the respective tensions of the elastomeric and the crimped non-elastomeric filaments when they are associated together. Preferably, the tensions are such that the crimped, non-elastic filament is taut, the crimp having been pulled or straightened out and that the elastomeric filaments are extended by substantially the same proportion of their original length as the non-elastomeric filaments are when the crimp is pulled out.

Tenaka et al. in Canadian Pat. No. 852,520, issued Sept. 29, 1970, disclose a method for manufacturing an elastomeric yarn covered with a multifilament, non-elastomeric yarn consisting of doubling an elastomeric yarn together with a drawn, non-elastomeric, multifilament yarn while maintaining the elastomeric yarn in a stretched condition into a doubled yarn. The doubled yarn is then twisted and untwisted by a false twist spindle (optionally while being provided with a heat set treatment). The doubled yarn is then relaxed and immediately thereafter is provided with real twist while in a stretched condition before being wound onto a package.

These prior art yarns and the methods employed in their manufacture have a number of disadvantages. Conventional single- or double-covered yarns, as disclosed in the above-mentioned U.S. Pat. No. 3,069,883, have a tendency to form filament loops on the surface of the yarn thereby detracting from the appearance and causing snagging and variable tension problems in the knitting operation. In addition, the conventional covering processes operate at low production rates and are consequently costly in terms of equipment and labour utilization. Composite yarns comprising an elastomeric yarn and a crimped, non-elastomeric yarn, as disclosed in the above-mentioned Canadian Pat. No. 719,047 tend to lack filament bundle cohesion, with the component filaments tending to separate, balloon, and snag. Improved cohesion can be obtained by twisting the composite yarn as described above, but this results in a less productive process and a more costly product. A similar disadvantage attends the process described in the above-mentioned Canadian Pat. No. 852,520, which requires a large amount of secondary twist (400 to 1100 turns/meter).

It is, therefore, an object of the present invention to provide an improved method for manufacturing, at high production rates, a composite yarn comprising an elastomeric yarn intermingled with a non-elastomeric multifilament yarn. It is a further object to provide a composite yarn comprising an elastomeric yarn intermingled with a non-elastomeric, multifilament yarn, the composite yarn being without real twist and having improved filament bundle cohesion.

With these and other objects in view, there is provided a method for manufacturing a composite yarn consisting of an elastomeric yarn intermingled with a non-elastomeric multifilament yarn comprising the steps of feeding an elastomeric yarn and a non-elastomeric, multifilament yarn through a draw zone adapted to temporarily stretch the elastomeric yarn and to draw the non-elastomeric multifilament yarn, and false twisting the elastomeric yarn and the non-elastomeric, multifilament yarn together to form a false twisted, doubled yarn while subjecting said false twisted, doubled yarn to a heat setting treatment at a temperature below that at which the elastomeric yarn elasticity would be substantially destroyed.

There is also provided a composite yarn comprising an elastomeric yarn intermingled with a non-elastomeric multifilament yarn, the yarn possessing alternating twist of random periodicity, but having zero net twist over an extended length of the yarn.

In the drawings, which illustrate embodiments of the invention:

FIG. 1A is an enlarged view of a "wobbler" device;

Figure 1:
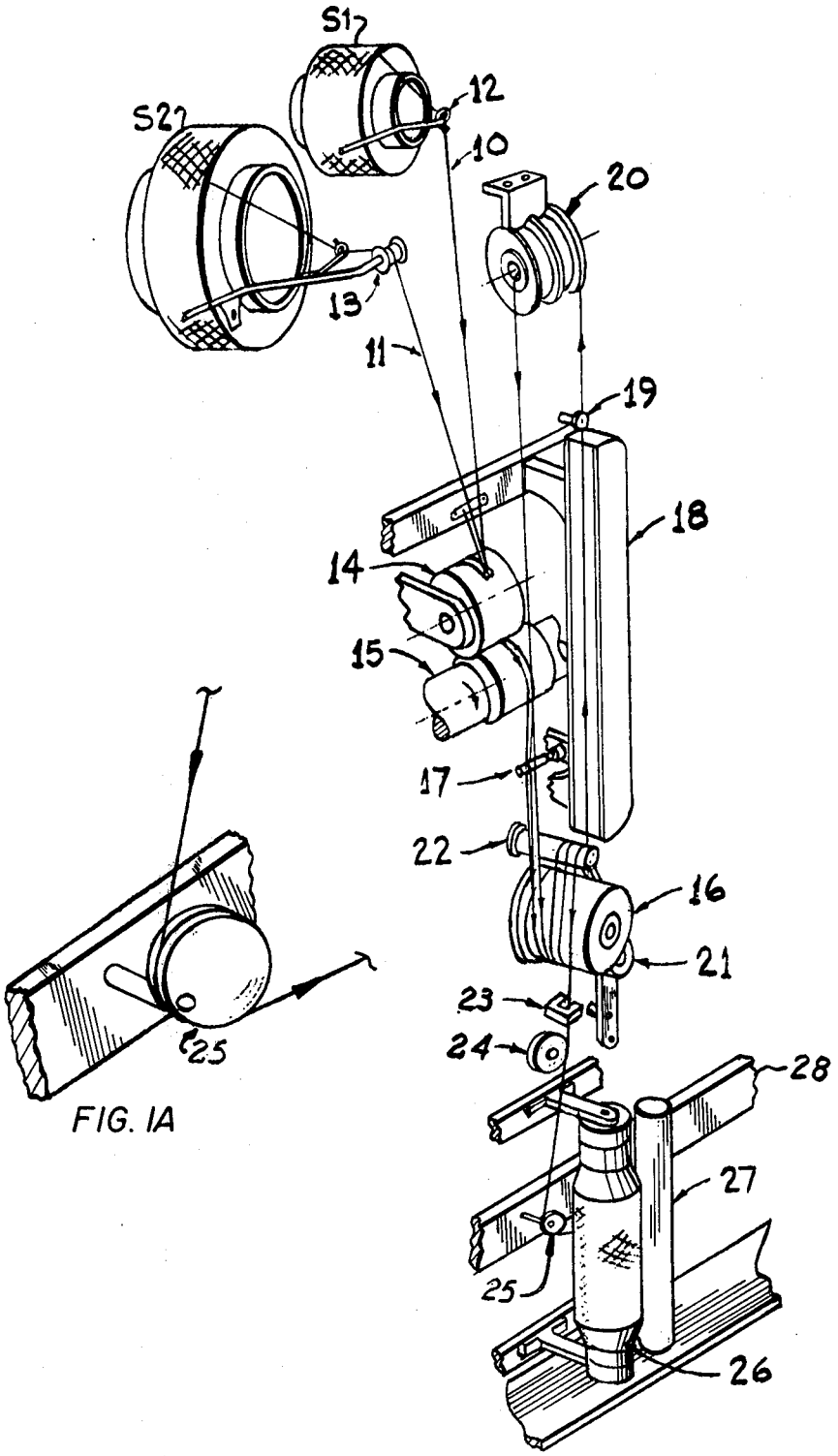
FIG. 1 shows a schematic view of a string-up of a conventional drawtwister modified in accordance with the invention.

Referring now to FIG. 1 of the drawings, the illustrated embodiment of the method of the invention comprises sources $S_1$ and $S_2$ of an elastomeric yarn 10 and a non-elastomeric, multifilament yarn 11, respectively. Yarns 10 and 11 pass over guides 12 and 13, respectively, and travel in side by side formation through the nip of a pair of engaging feed rolls 14 and 15. Roll 15 is driven at a predetermined peripheral rate of speed for forwarding the yarns 10 and 11 at one peripheral speed to draw roll 16 which is driven at a faster peripheral speed than feed roll 15 to draw or stretch the yarns therebetween. Optionally a draw pin 17 may be positioned between the feed rolls 14 and 15 and draw roll 16 and either the non-elastomeric multifilament yarn 11 or both the non-elastomeric yarn 11 and the elastomeric yarn 10 may be wrapped around pin 17 effecting orientation by stretching the yarn 11 about the locality of the pin 17. The yarns pass around draw roll 16 and are forwarded over a heater 18, over a guide 19 and through a false twisting device 20 which imparts twist into the combined yarns. Pinch roll 21 engaging the periphery of draw roll 16 prevents the twist from travelling over the draw roll 16. The combined yarn leaving the false twisting device 20 untwists, passes around draw roll 16 and separator roll 22. To improve subsequent knitting performance it is preferred that the combined yarn then pass through an interlace jet 23 and over a finish roll 24, about a "wobbler" pulley 25 with an eccentric axis mounted on a traverse bar 28 which traverses parallel to the rotational axis of the package. The combined yarn is then wound onto a surface driven package 26, which is rotated by a belt driven roller 27. Pulley 25 introduces a sinusoidal yarn laydown resulting in a variation of about ± 10° in the otherwise essentially parallel yarn laydown on package 26 thereby improving subsequent unwinding characteristics of the package. It will be appreciated that the yarn may be wrapped completely around the circumference of pulley 25 one or more times for some embodiments but that usually it will be sufficient to merely bend the yarn about pulley 25. The illustrated package 26 take-up mechanism allows the production of combined or composite yarn, possessing alternating twist of random periodicity, but having zero net twist over an extended length of the yarn. It will be appreciated that the package 26 may be driven at a lower peripheral speed than the peripheral speed of draw roll 16 in order to allow relaxation of the composite yarn during wind-up.

Figure 2:
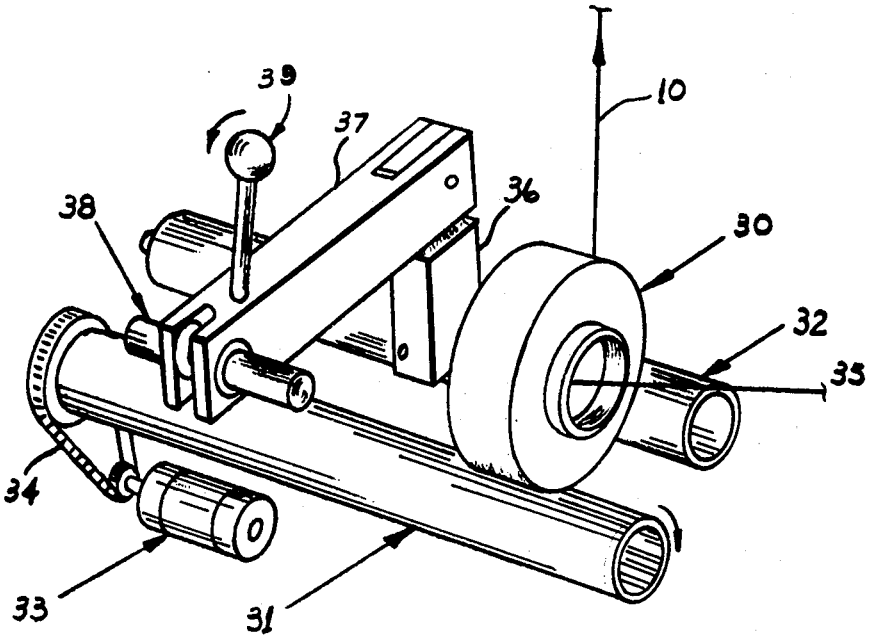
FIG. 2 shows a schematic view of a positive feed device.

It is preferred that a positive feed device be used with the elastomeric yarn 10 to provide uniform tension during supply. Such a device is illustrated in FIG. 2 where the elastomeric yarn package 30 rests on a positively driven roll 31 and an idler roll 32. The positively driven roll 31 is powered by motor 33 which acts through a conventional belt drive 34. The elastomeric yarn package 30 is also mounted upon a chuck 35 which rotates freely on a hinged arm 36, said arm 36 being attached to another arm 37 which pivots about a bar 38. The combined effect of the two hinged arms allows the package 30 to maintain contact with both rolls 31 and 32 while said package 30 decreases in size. Further there is a handle 39 provided for engaging or disengaging the elastomeric yarn package 30.

It is preferred that the non-elastomeric multifilament yarn 11 fed by feed rolls 14 and 15 be an undrawn and untextured yarn. It will be appreciated, however, that the non-elastomeric, multifilament yarn 11 may also be a partially drawn yarn, a fully drawn yarn or a fully drawn and textured yarn. Where the non-elastomeric yarn is fully drawn or fully drawn and textured, this yarn would not be fed by feed rolls 14 and 15, but would pass directly to draw roll 16 from source $S_2$.

It will be appreciated that the heat setting temperature may be varied depending on the length of the heating zone and the yarn speed of any particular process. Nevertheless heat setting temperatures would normally be about 70° F lower than those normally used in false twist texturing processes, the upper limit on temperature being that temperature at which the elasticity of the elastomeric yarn is substantially destroyed.

The following examples illustrate the present invention without limiting its scope.

EXAMPLE 1

Figure 3:
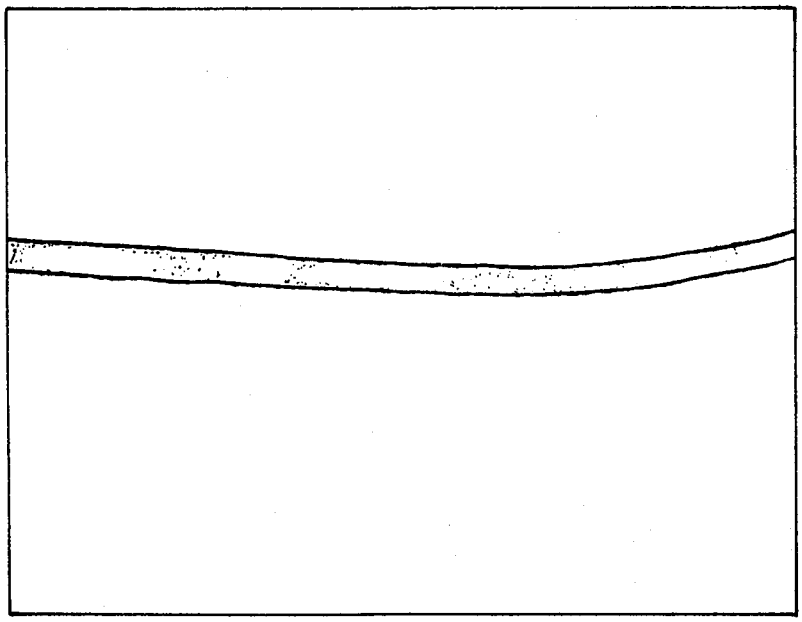
FIG. 3 shows a magnified portion of a 20 denier monofilament spandex fibre.

A composite yarn was produced from a supply of 20 denier monofilament LYCRA spandex fibre and a supply of undrawn nylon 66 yarn having 7 filaments on apparatus hereinbefore described and illustrated in FIG. 1. A magnified portion of the 20 denier monofilament spandex fibre is shown in FIG. 3. The process conditions were as follows:

a. draw ratio, i.e. ratio of the peripheral speed of draw roll 16 to the peripheral speed of feed roll 15 was 2.66;

b. temperature of heater 18 was 150° C.;

c. The high-speed friction false twisting device 20 imparted 110 turns per inch into the combined yarns;

d. a lubricant was applied to the combined yarns by lubricant applicator 24; and e. the package 26 was driven by roller 27 at a peripheral speed 3% lower than the 300 yards per minute peripheral speed of the draw roll 16.

Figure 4:
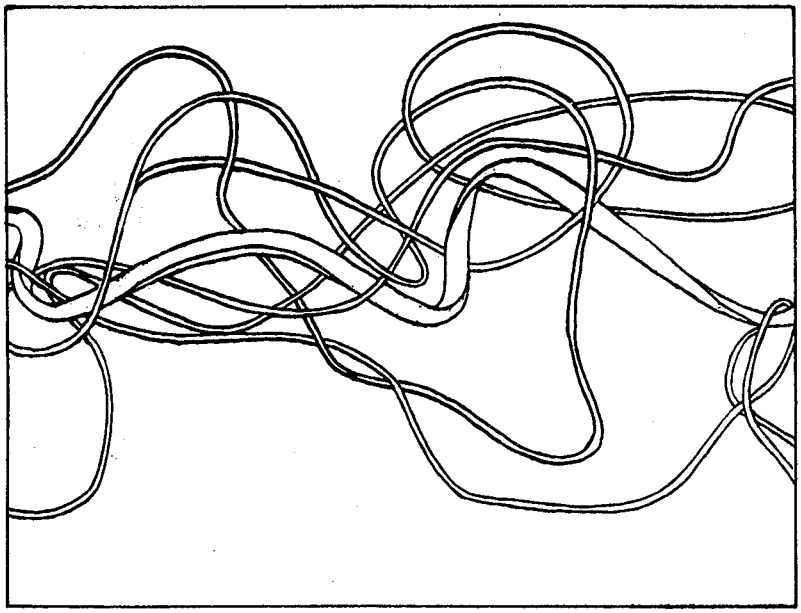
FIG. 4 shows a sketch of composite yarn of the present invention removed from the package and under zero tension as it appears under a microscope.

The composite yarn was removed from the package and placed at zero tension under a microscope. As illustrated in FIG. 4, the spandex fibre component, in about the centre, was entangled with filaments of the textured multifilament nylon 66. The spandex fibre component exhibited both distortion from its originally round cross-section (see FIG. 3) and permanently set false twist.

The appearance of the composite yarn before the interlace step is characterized by a central spandex fibre possessing typical false twist helical crimps surrounded by substantially bulked nylon filaments. These filaments although well intermingled with the spandex fibres prior to interlace, pursue individual paths as they follow the general direction of the spandex core. The interlace step improves elastomeric and non-elastomeric filament association and the interlaced yarn demonstrates improved performance during knitting. It will be appreciated that a number of other methods are known to improve filament association and knitting performance.

Figure 5:
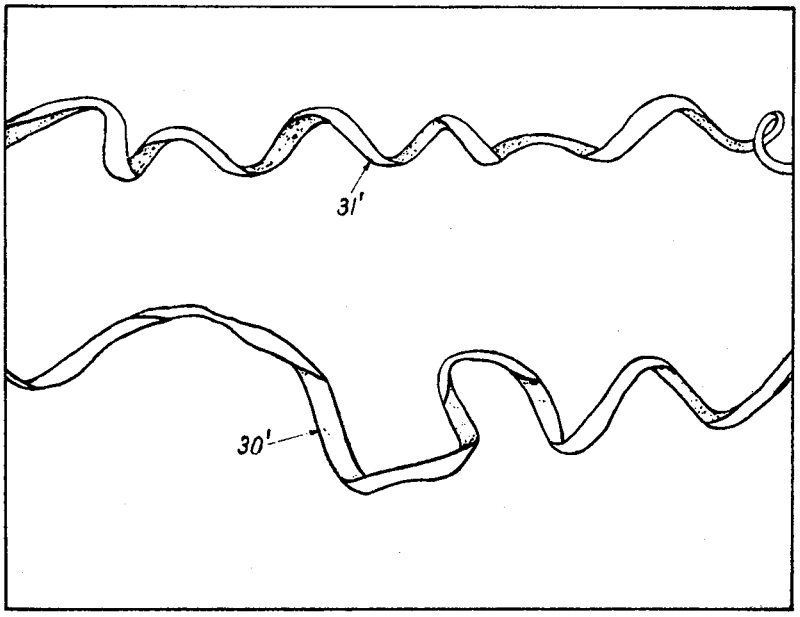
FIG. 5 shows magnified portions of monofilament spandex fibres, the fibres having been separated from composite yarns of the present invention.

The spandex fibre component was removed from the composite yarn illustrated in FIG. 4 and placed at zero tension under a microscope. A magnified portion of this spandex fibre component is indicated by the numeral 30 in FIG. 5.

Measurements of the physical properties of the composite yarn and those of its component yarns were made and are given in the table below.

TABLE

| | Composite Yarn | Nylon 66 Component | Spandex Component |
|---|---|---|---|
| Denier (grams/9000 meters) | 29.85* | 24.36* | 14.0** |
| Elongation to break (%) | 98.58 | 80.65 | 389.15 |
| Tenacity (grams/denier) | 3.93 | 3.97 | 1.59 |

* Denier was measured with yarns stretched just enough to pull out the crimps of the nylon yarn.

**Denier was measured as follows: the spandex component was separated from the nylon filaments and wound at zero tension onto a roller having a helical groove on its surface, each convolution measuring 9.0 cm. The weight of ten convolutions was measured on a precision balance and converted to denier in grams per 9000 meters.

With the composite yarn stretched just enough to pull out the nylon yarn crimps, the spandex component constituted 18.4% of the total denier of the composite yarn.

It was noted that the spandex fibre had been permanently reduced in denier from 20 denier to 14 denier, a reduction of 30%. This reduction in denier, which is due to the heat treatment step over heater 18, is explained by Frank B. Moody in Canadian Pat. No. 621,569, issued June 6, 1961.

EXAMPLE 2

A composite yarn was produced from a supply of 20 denier monofilament LYCRA spandex fibre and a supply of undrawn nylon 66 yarn having seven filaments in the same manner as in Example 1 with the exception that immediately before the lubricating step, the combined yarn was passed (for a second time) over heater 18. This additional heat treatment step is referred to as "post-treating".

The measured physical properties of the post treated composite yarn showed no appreciable difference from those of the composite yarn of Example 1.

The spandex fibre component was removed from the post treated composite yarn from a package and placed at zero tension under a microscope. The magnified portion of this spandex fibre component is indicated by the numeral 31' in FIG. 5. A comparison between this spandex fibre component 31' and spandex fibre component 30' from the composite yarn (without post treatment) of Example 1, indicates that the crimp development in spandex fibre component 31' is augmented by the post treatment step.

Figure 6:
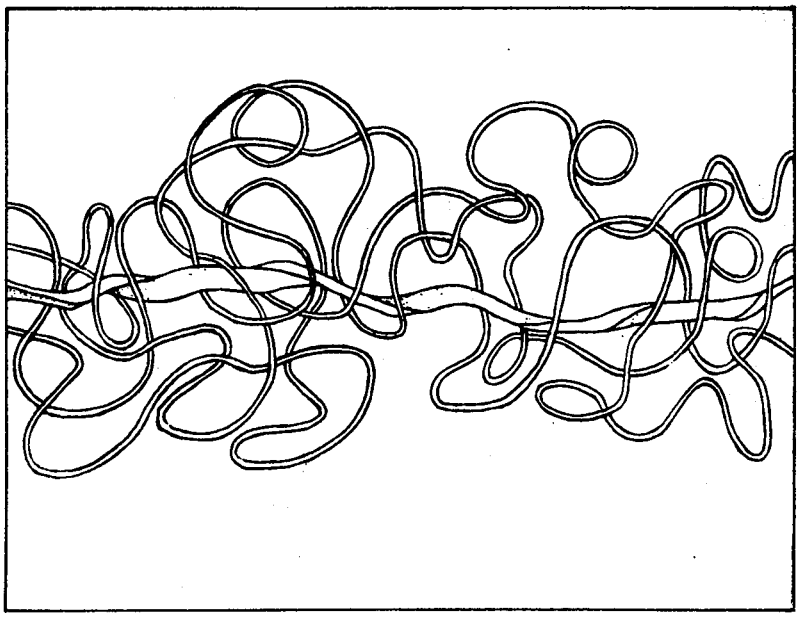
FIG. 6 shows a magnified portion of composite yarn of the present invention, the composite yarn having been removed from finished ladies' hose.
Figure 7:
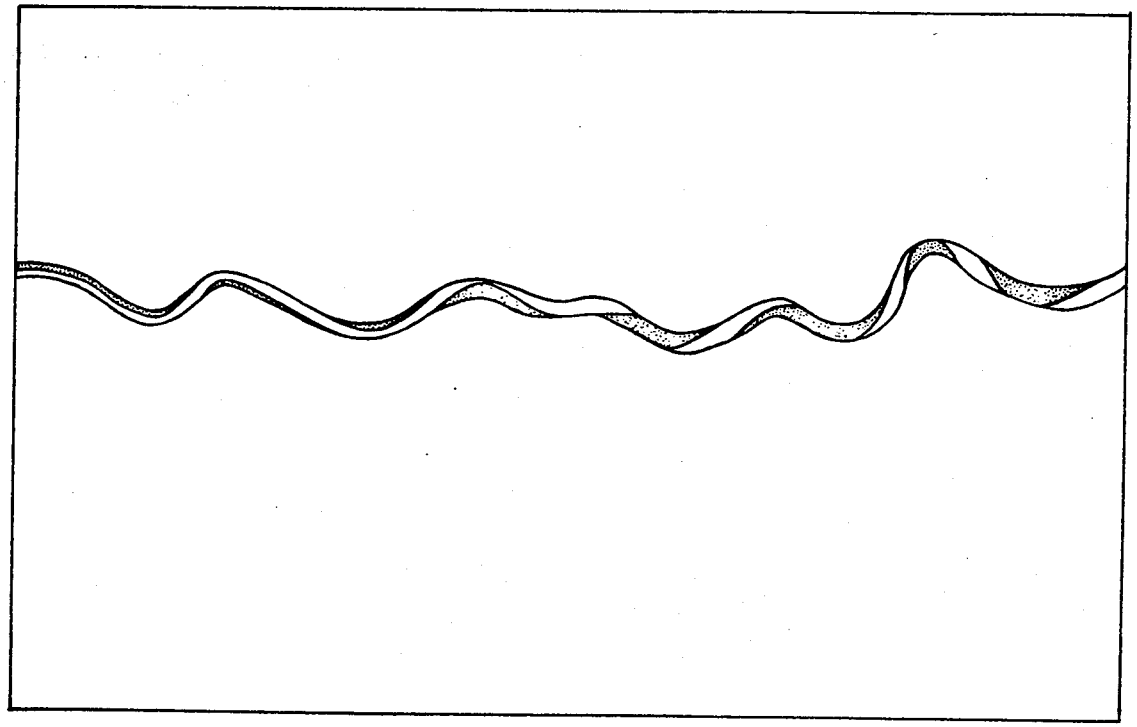
FIG. 7 shows a magnified portion of monofilament spandex fibre, the fibre having been separated from composite yarn of the present invention, the yarn having been removed from finished ladies' hose.

The composite yarns from Example 1 and Example 2 were knit separately into ladies' hose on a four-feed knitting machine along with 20 denier, 7 filament, regular, textured nylon 66 yarn, which alternated with the composite yarn in successive courses. The hose were processed through the standard finishing procedure. The following conclusions were drawn based on examination of the finished hose:

1. knittability was excellent;

2. the hose exhibited high power and excellent recovery (comparable to those of present commercial products) as well as good stitch clarity and sheerness;

3. microscopic examination of the yarn taken out of the hose showed that the twist set into the composite yarn remained permanent (see FIG. 6) as did the twist set into the spandex fibre itself when separated from the composite yarn (see FIG. 7).

Although the above examples relate to low denier composite yarn suitable for hosiery, it will be appreciated that the process of the present invention may be used to make composite yarns suitable for heavier denier products such as knitwear, half hose and others.

The embodiments of the invention in which an exclusive property or privilege are claimed are defined as follows:

1. A method of manufacturing a composite yarn consisting of a false-twist crimped, heat-set, elastomeric yarn intermingled with a crimped, substantially heat-set, non-elastomeric multifilament yarn, which comprises the steps of:

a. feeding an elastomeric yarn and an incompletely drawn, non-elastomeric multifilament yarn through a draw zone adapted to temporarily stretch the elastomeric yarn and to draw the non-elastomeric yarn, and b. false-twisting the elastomeric yarn and the non-elastomeric yarn together while heat-setting twist in the combined yarns at a temperature below that at which the elasticity of the elastomeric yarn would be substantially destroyed, followed by untwisting the heat-set twist to form a crimped composite yarn.

2. The process of claim 1 wherein the non-elastomeric yarn is nylon 66 yarn.

3. The process of claim 2 wherein the elastomeric yarn is composed of spandex fibre.

4. The process of claim 1 wherein the false twisting step is carried out on a false-twisting device which comprises a friction twist device.

5. The process of claim 1 including the step, after the heat setting treatment, of winding the composite yarn onto a surface driven package without inserting any real twist into the yarn.

6. The process of claim 1 where the elastomeric yarn is fed by a positive feed device.

7. The process of claim 1 including the step of interlacing the false twisted doubled yarn.

8. The process of claim 1 including the step of winding the composite yarn onto a package by means of an eccentrically mounted pulley mounted on a conventional traverse bar thereby introducing a $\pm 10°$ sinusoidal variation in the otherwise essentially parallel yarn laydown.

9. The process of claim 1 where the non-elastomeric multifilament feedyarn is a textured yarn.

10. A composite yarn produced by the process defined in claim 1 and comprising a false twist crimped, heat set elastomeric yarn intermingled with a crimped, substantially heat set, non-eleastomeric multifilament yarn, the composite yarn possessing alternating twist of random periodicity, but having a zero net twist over an extended length of the yarn.

* * * * *